US006328117B1

(12) United States Patent
Berzas et al.

(10) Patent No.: US 6,328,117 B1
(45) Date of Patent: Dec. 11, 2001

(54) DRILL BIT HAVING A FLUID COURSE WITH CHIP BREAKER

(75) Inventors: Sean K. Berzas, The Woodlands, TX (US); Ralf Duerholt, Aberdeen (GB); Rudolf C. O. Pessier, Houston; Danny E. Scott, Montgomery, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/543,490

(22) Filed: Apr. 6, 2000

(51) Int. Cl.[7] ..... E21B 10/46; E21B 10/62

(52) U.S. Cl. ..... 175/57; 175/431; 175/432

(58) Field of Search ..... 175/57, 428, 429, 175/431, 432, 379

(56) References Cited

U.S. PATENT DOCUMENTS

| | | | | |
|---|---|---|---|---|
| 3,915,246 | | 10/1975 | Sheshtawy . | |
| 4,606,418 | | 8/1986 | Thompson . | |
| 4,852,671 | | 8/1989 | Southland . | |
| 4,883,132 | | 11/1989 | Tibbitts . | |
| 4,913,244 | | 4/1990 | Trujillo . | |
| 4,984,642 | | 1/1991 | Renard et al. . | |
| 5,115,873 | | 5/1992 | Pastusek . | |
| 5,172,778 | | 12/1992 | Tibbitts et al. . | |
| 5,433,280 | | 7/1995 | Smith . | |
| 5,447,208 | | 9/1995 | Lund et al. . | |
| 5,531,281 | | 7/1996 | Murdock . | |
| 5,582,258 | | 12/1996 | Tibbitts et al. . | |
| 5,651,420 | * | 7/1997 | Tibbitts et al. | 175/102 |
| 5,901,797 | * | 5/1999 | Hansen et al. | 175/102 |
| 5,957,227 | | 9/1999 | Besson et al. . | |
| 5,992,549 | | 11/1999 | Fuller . | |
| 6,006,846 | * | 12/1999 | Tibbitts et al. | 175/428 |
| 6,065,554 | * | 5/2000 | Taylor et al. | 175/430 |
| 6,106,585 | * | 8/2000 | Packer et al. | 51/309 |

FOREIGN PATENT DOCUMENTS 2 085 945 A 10/1981 (GB) .

* cited by examiner

*Primary Examiner*—Frank Tsay
(74) *Attorney, Agent, or Firm*—TraskBritt

(57) ABSTRACT

A chip breaker for use in a fixed-cutter, rotary-type drill bit used in drilling subterranean formations is disclosed. The chip breaker includes a knife-like protrusion positioned proximate a cutting element and adjacent or in a fluid course defined by the drill bit body. As formation chips, shavings, or cuttings are generated during drilling, the chips move over the protrusion and are split or scribed by the protrusion. Drilling fluid breaks the split or scribed chips away from the surface of the fluid course adjacent the cutting element and transports them through the junk slots. Additionally, chip splitters may be positioned on ramped surfaces that further lift the formation chips away from the surface of the fluid course.

22 Claims, 4 Drawing Sheets

DRILL BIT HAVING A FLUID COURSE WITH CHIP BREAKER

BACKGROUND OF THE INVENTION

1. Field of the Invention

The present invention relates generally to rotary-type drag bits used in drilling subterranean formations and, more particularly, to such drill bits employing chip breakers to facilitate the break up of formation chips generated during drilling, resulting in more effective removal of the chips from around the drill bit with drilling fluid.

2. State of the Art

Fixed-cutter rotary drag bits have been employed in subterranean drilling for many decades with various sizes, shapes and patterns of natural and synthetic diamonds used on drag bit crowns as cutting elements. Rotary drag-type drill bits are typically comprised of a bit body having a shank for connection to a drill string and encompassing an inner channel for supplying drilling fluid to the face of the bit through nozzles or other apertures. Drag bits may be cast and/or machined from metal, typically steel, or may be formed of a powder metal (typically tungsten carbide (WC)) infiltrated at high temperatures with a liquified (typically copper-based) binder material to form a matrix. Such bits may also be formed with layered-manufacturing technology, as disclosed in U.S. Pat. No. 5,433,280, assigned to the assignee of the present invention and incorporated herein by this reference.

The bit body typically carries a plurality of cutting elements mounted directly on the face of the bit body or on carrier elements adjacent fluid courses to allow cuttings (i.e., formation chips) generated during drilling to flow from the cutting elements to and through junk slots on the gage of the bit and to the bore hole annulus above the bit. Cutting elements may be secured to the bit by preliminary bonding to a carrier element, such as a stud, post, or cylinder, which in turn is inserted into a pocket, socket, recess or other aperture in the face of the bit and mechanically or metallurgically secured thereto.

One type of drag bit includes polycrystalline diamond compact (PDC) cutters typically comprised of a large diamond table (usually of circular, semi circular or tombstone shape) which presents a generally planar cutting face. A cutting edge (sometimes chamfered or beveled) is formed on one side of the cutting face which, during boring, is at least partially embedded into the formation so that the formation is received against at least a portion of the cutting face. As the bit rotates, the cutting face moves against the formation and shavings of formation material are sheared off and ride up the surface of the cutter face. In brittle materials the shavings easily separate from the cutter face and break down into small particles that are transported out of the bore hole via circulating drilling fluid. Another shaving then begins to form in the vicinity of the cutting edge, slides up the face of the cutting surface, and breaks off in a similar fashion. Such action occurring at each cutting element on the bit removes formation material over the entire face of the bit, and so causes the bore hole to become progressively deeper.

However, in formations that behave more plastically, such as highly pressurized deep shales, mudstones, and siltstones, the formation shavings have a marked tendency to stay intact and adhere to the cutting face of the cutting element.

When these formation shavings adhere to the cutting face and do not break into smaller pieces, the shavings tend to collect and to build up as a mass of cuttings ahead of the PDC cutting elements and eventually clog the entire open bit space with drilled-up material. Once the bit is clogged with drilled-up material, the bit ceases to drill effectively.

Undesired accumulation of shavings, or cuttings, from subterranean formations being drilled by drag bit PDC cutting elements has long been recognized as a problem in the subterranean drilling art, particularly in formations of highly pressurized shale. A number of different approaches have been attempted to facilitate removal of formation cuttings from the cutting face of PDC cutting elements. For example, U.S. Pat. No. 5,582,258 to Tibbitts et al., assigned to the assignee of the present invention and herein incorporated by this reference, includes a chip breaker formed adjacent the cutting edge of the cutting elements to impart strain to a formation shaving by bending and/or twisting the shaving and thereby increasing the likelihood that the chip will break away from the face of the blade portion of the bit. Other approaches to solving the problem of formation chip removal include U.S. Pat. No. 4,606,418 to Thompson, which discloses cutting elements having an aperture in the center thereof which feeds drilling fluid from the interior of the drill bit onto the cutting face to cool the diamond table and to remove formation cuttings. U.S. Pat. No. 4,852,671 to Southland discloses a diamond cutting element which has a passage extending from the support structure of the cutting element to the extreme outermost portion of the cutting element, which is notched in the area in which it engages the formation being cut so that drilling fluid from a plenum on the interior of the bit can be fed through the support structure and to the edge of the cutting element immediately adjacent the formation. U.S. Pat. No. 4,984,642 to Renard et al. discloses a cutting element having a ridged or grooved cutting face on the diamond table to promote the break up of formation chips, or, in the case of a machine tool, the break up of chips of material being machined, and enhance their removal from the cutting face. The irregular topography of the cutting face assists in preventing balling or clogging of the bit by reducing the effective surface or contact area of the cutting face, which also reduces the pressure differential of the formation chips being cut. U.S. Pat. No. 5,172,778 to Tibbitts et al., assigned to the assignee of the present application, employs ridged, grooved, stair-stepped, scalloped, waved and other alternative non planar cutting surface topographies to permit and promote the access of fluid in the bore hole to the area on the cutting face of the cutting element immediately adjacent to and above the point of engagement with the formation. Such a non planar cutting surface helps to equalize differential pressure across the formation chip being cut and thus reduce the shear force which opposes chip movement across the cutting surface. U.S. Pat. No. 4,883,132 to Tibbitts, assigned to the assignee of the present application, discloses a novel drill bit design providing large cavities between the face of the bit and the cutting elements engaging the formation. Formation cuttings entering the cavity area are thus unsupported and more likely to break off for transport up the bore hole. In addition, clearing of the chips is facilitated by nozzles aimed from behind the cutting elements (taken in the direction of bit rotation) so that the chips are impacted in a forward direction to break off immediately after being cut from the formation. U.S. Pat. No. 4,913,244 to Trujillo, assigned to the assignee of the present invention, discloses bits which employ large cutters having associated therewith directed jets of drilling fluid emanating from specifically oriented nozzles placed in the face of the bit in front of the cutting elements. The jet of drilling fluid is oriented so that the jet impacts between the cutting face of the cutting element and a formation chip as it is moving along the cutting face to peel the chip away from the cutting element and toward the gage of the bit. Likewise, GB 2,085,945 to Jurgens provides nozzles that direct drilling fluid toward the cutting elements to flush away cuttings generated by the cutting elements. U.S. Pat. No. 5,447,208 to Lund et al., assigned to the assignee of the present invention, discloses a superhard cutting element having a polished, low-friction, substantially planar cutting face to reduce chip adhesion across the cutting face. Finally, U.S. Pat. No. 5,115,873 to Pastusek, assigned to the assignee of the present application, discloses yet another manner in which formation cuttings can be removed from a cutting element by use of a structure adjacent and/or incorporated with the face of the cutting element to direct drilling fluid to the face of the cutting element and behind the formation chip as it comes off the formation.

It will be appreciated by those skilled in the art that the foregoing approaches require significant modification to the cutting elements themselves, to the structure carrying the cutting elements on the bit face, and/or to the bit itself Thus, the foregoing approaches to the problem require significant expenditures which substantially raise the price of the drill bit. In addition, due to required cutter placement on certain styles and sizes of bits for efficient and effective cutting, many of the prior art hydraulic chip removal arrangements are unsuitable for general application. Accordingly, it would be desirable to provide the industry with a solution to the breakdown and dispersion of large chips, or shavings, which solution could be economically effected on any fixed-cutter drill bit regardless of size or style, and regardless of the type of formation which might be expected to be encountered by the drill bit.

SUMMARY

The present invention provides a rotary-type drill bit comprising a bit body having a plurality of longitudinally extending blades, the blades defining fluid courses with communicating junk slots there in between. A plurality of cutting elements [are]is attached to the blades, each cutting element including a cutting face adjacent a fluid course. Upon rotation of the drill bit into a subterranean formation, formation shavings cut by a cutting element slide across the cutting face, into a fluid course, and through a communicating junk slot.

In a preferred embodiment, a protrusion is positioned proximate each cutting element on the surface of the bit face such that, as a formation shaving slides across the cutting face of the cutting element, the protrusion splits and/or breaks up the chip into two or more segments. By splitting the shavings, or chips, new surfaces are generated, allowing the drilling fluid to penetrate into the cracks and pores of the shavings, or chips, reducing their integrity and making it easier to break them down and disperse them. Preferably, the protrusion includes a leading edge proximate to and in the path of the shavings generated by the cutting element to allow the formation chips to be split without substantially impeding flow of the formation chips over the face of the cutting element.

In another preferred embodiment, formation shavings, or chips, sliding across the cutting face are intercepted and split by the protrusion, and the protrusion also lifts the shaving, or chip, away from the face of the blade adjacent the cutting face so that drilling fluid can get under the portions of the split shaving, or chip, and carry the dislodged shaving, or chip, generally upwardly through the associated junk slot.

In yet another preferred embodiment, the protrusion is positioned on a ramped blade surface, such as the ramped surface of the chip breakers disclosed in U.S. Pat. No. 5,582,258. Formation shavings or chips sliding across such a ramped surface and intercepted by the protrusion provided by the present invention are split and lifted or split, lifted, and twisted away from the face of the blade to allow drilling fluid flowing through the fluid course to surround the entire shaving, or chip, and penetrate cracks and pores therein to further weaken and disperse the shaving, or chip. The ramped surface may include substantially planar surfaces, concave surfaces, convex surfaces or combinations thereof.

In another preferred embodiment, the chip splitter includes a rounded or diamond-shaped protuberance.

The projections herein described can be manufactured directly into the body of the drill bit or separately manufactured and subsequently attached to the surface of a drill bit. Accordingly, the projections can be adapted to existing drill bits known in the art by bonding, brazing, or otherwise attaching the projections by methods known in the art to bits of conventional design.

DETAILED DESCRIPTION OF THE ILLUSTRATED EMBODIMENT

Figure 1:
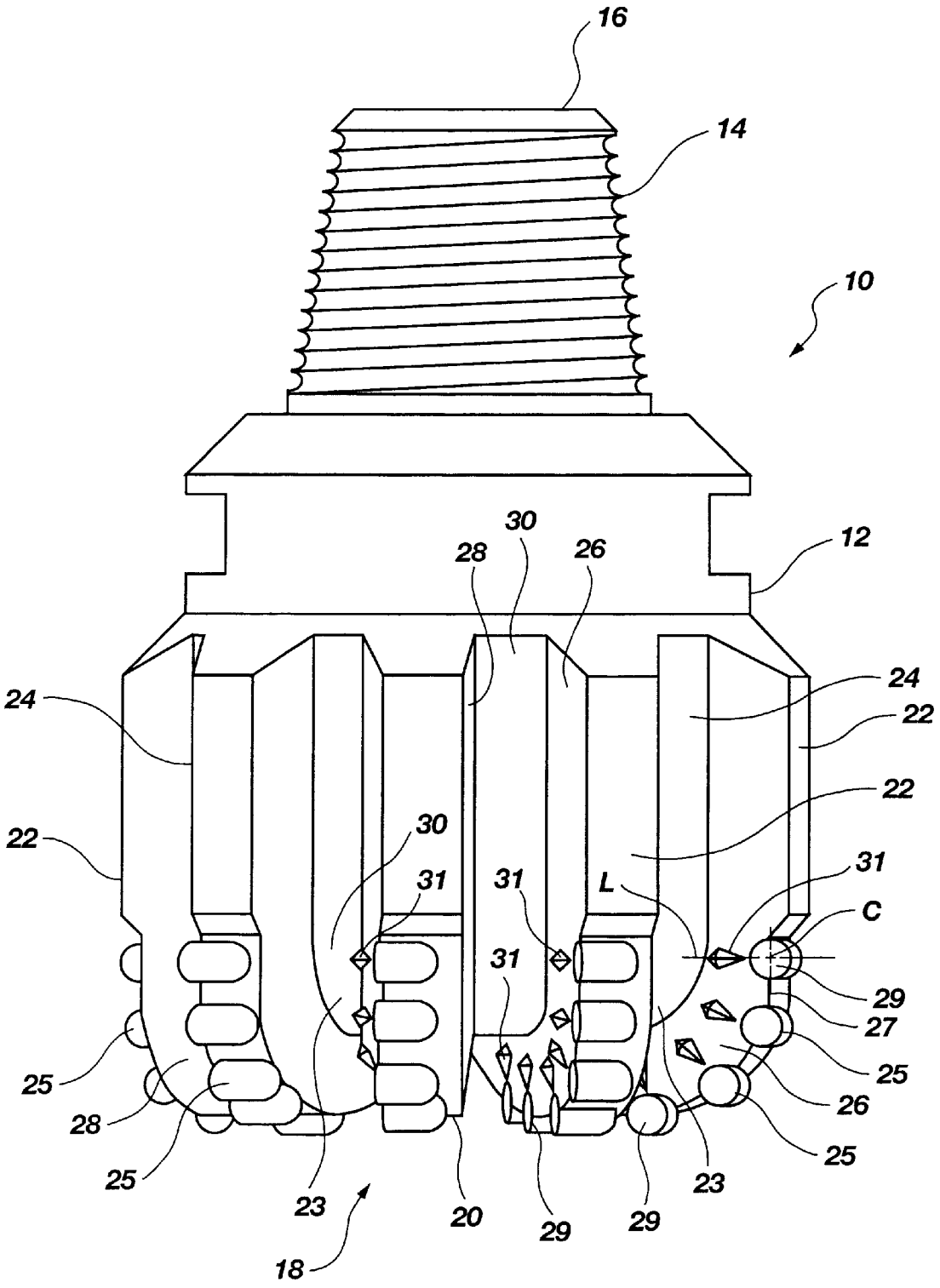
FIG. 1 is a perspective side view of a first embodiment rotary-type drill bit in accordance with the present invention.

Referring to FIG. 1, a drill bit 10 in accordance with the present invention comprises a bit body 12 having a threaded connection 14 at a proximal end 16 thereof and a crown 18 at a distal end 20 thereof. The bit crown 18 includes a plurality of longitudinally extending blades 22 that defines a plurality of fluid courses 23 with communicating junk slots 24 thereinbetween. Along each blade 22, proximate the distal end 20 of the bit body 12, is a plurality of cutting elements 25 attached to the leading edge 27 of the blades 22 and oriented to cut into a subterranean formation upon rotation of the bit 10.

As illustrated, the fluid courses 23 and junk slots 24 are specifically defined by a first, "leading" side wall 26, a second, "trailing" side wall 28 and a bottom surface 30. The "leading" side wall 26 provides a surface adjacent the cutting face 29 of the cutting elements 25. A plurality of chip splitters 31 are each attached to or integrally formed with the "leading" side wall 26 and are each positioned proximate to a cutting element 25. In addition, each chip splitter 31 preferably has a longitudinal axis L that is in substantial alignment with the center C of the adjacent cutting face 29 so that, as formation chips are generated during drilling, the chip splitters 31 preferably cut such a chip into two substantially equal portions. It is noted that the orientation or alignment of the longitudinal axis L relative to the cutting face 29 may depend on the location of the cutting element 25 on the bit 10 and the predicted direction of chip generation over the cutting face 29. Accordingly, as formation chips, also referred to herein as shavings or cuttings, are cut by the cutting elements 25, the chips slide over the cutting face 29 and across the "leading" side wall 26 adjacent the cutting elements 25, are split by the chip splitters 31, and are carried away by drilling fluid flowing through the fluid course 23.

Figure 2:
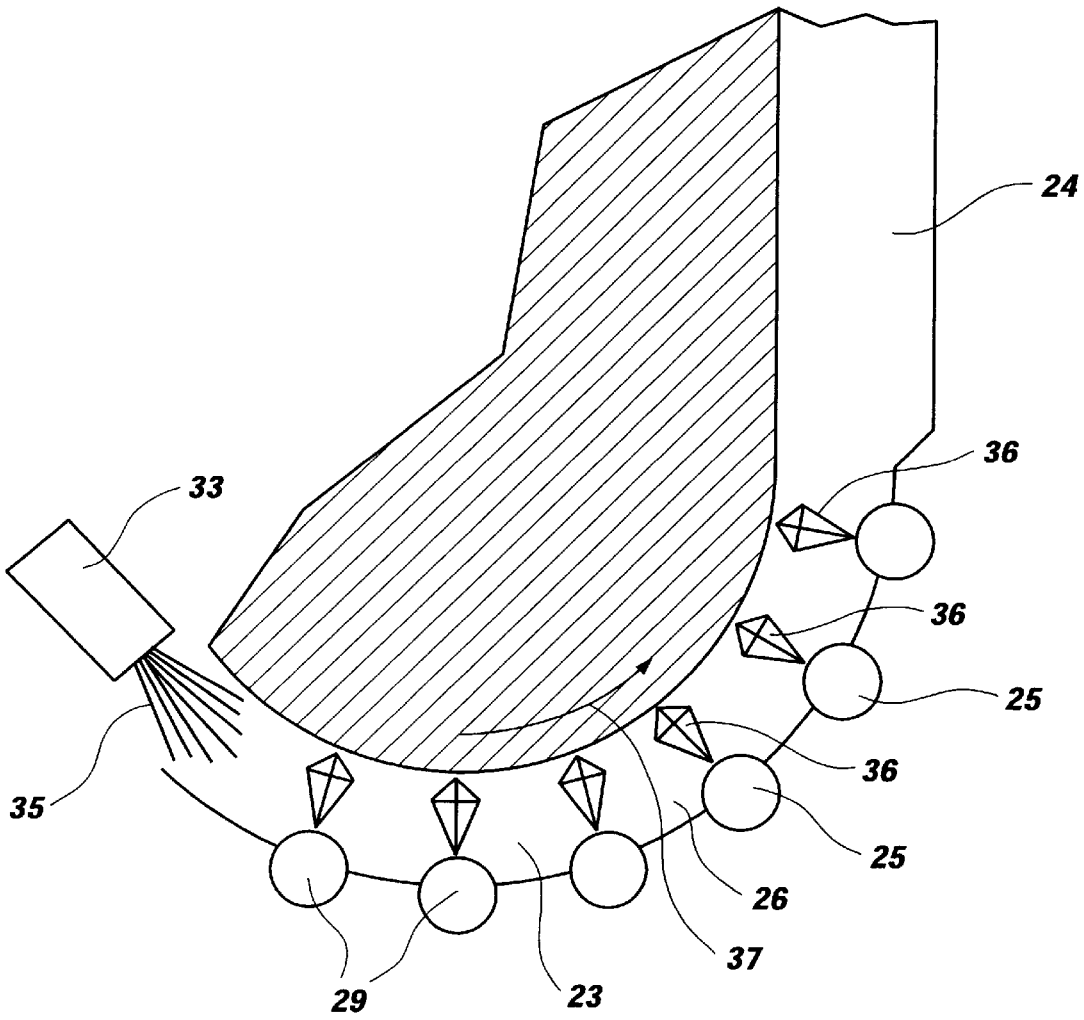
FIG. 2 is a partial sectional view of a second embodiment of a rotary-type drill bit illustrating the flow of drilling fluid through a fluid course of the drill bit.

As further illustrated in FIG. 2, drilling fluid 35 directed by nozzle 33 circulating (represented by arrow 37) through the fluid course 23 and communicating junk slot 24 removes formation chips from the cutting elements 25 and provides a substantially clean cutting face 29 during drilling, especially in friable or unconsolidated formations. In some situations, such as drilling formations having plastic deformation characteristics, the formation chips, shavings, or cuttings may tend to stick or adhere to the cutting face and the adjacent "leading" side wall 26 of blade 22. Accordingly, drilling fluid 35 flowing through the fluid course 23 may not adequately lift the formation chips from the "leading" side wall 26. To aid in more efficient removal of formation chips from the "leading" side wall 26, a plurality of protrusions or chip splitters 36 is provided on "leading" side wall 26, each adjacent a cutting element 25. These protrusions or chip splitters 36 are generally formed to have a leading "knife-edge" to break the formation chips into at least two segments so that the force of the drilling fluid 35 can impinge upon smaller chip segments, rather than a single, more massive chip, and break them away from the "leading" side wall 26. The broken chip segments can then be carried by the drilling fluid 35 through the fluid course 23 and into communicating junk slot 24.

Figure 3:
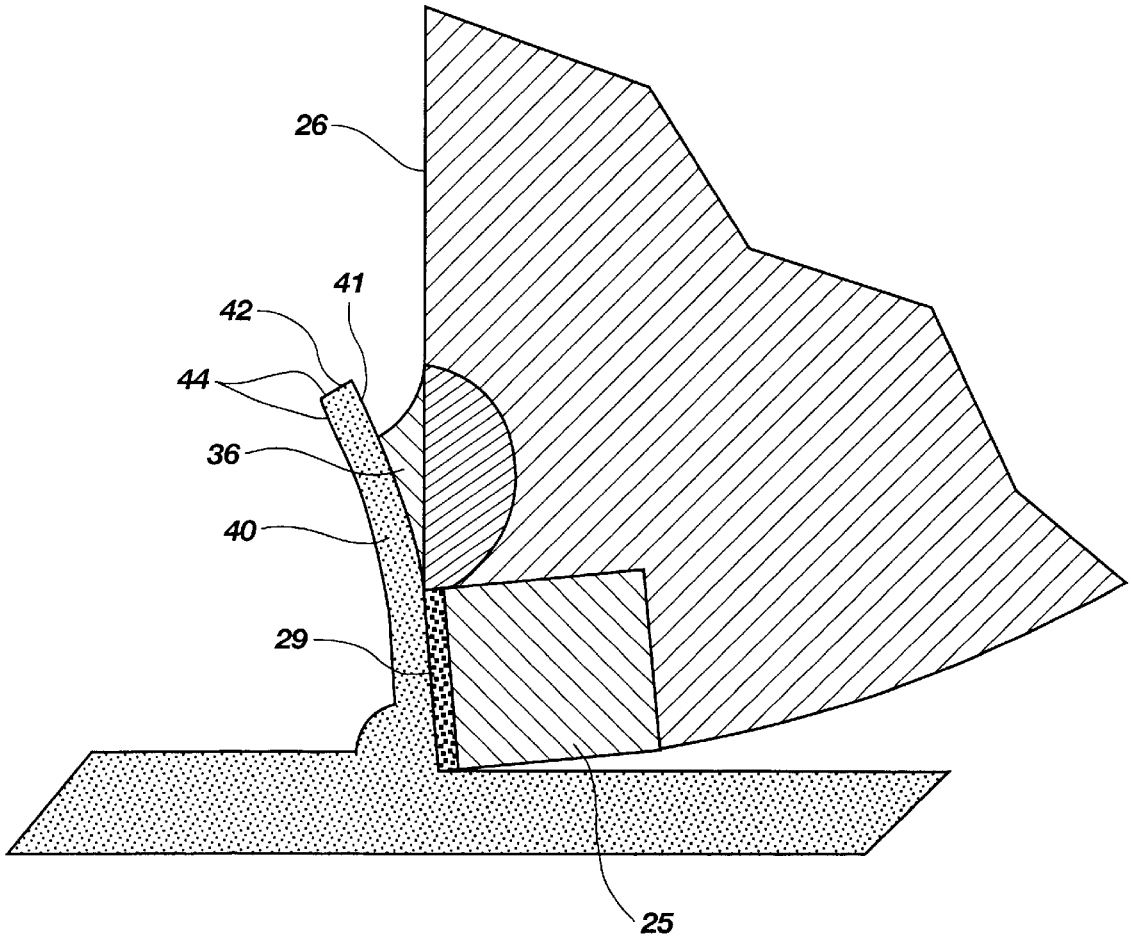
FIG. 3 is a partial sectional view of a formation chip being cut by a cutting element on a drill bit in accordance with the present invention.

As illustrated in FIG. 3, formation chip 40 may be both split and lifted or split, lifted, and twisted away from "leading" side wall 26 by chip splitter 36 relative to cutting face 29 of cutting element 25 and "leading" side wall 26. By splitting and lifting the chip 40 away from "leading" side wall 26, the unsupported portion 44 of the chip 40 that is exposed to the flow of drilling fluid is weakened by drilling fluid penetrating into cracks and pores and can be relatively easily broken away from the rest of the chip 40 by the force of drilling fluid flowing through the fluid course. Segments 42 of chip 40, one of which is viewable in FIG. 3 with the other directly therebehind, will typically have two additional sides 41 exposed to the action of the drilling fluid for further breaking segments 42 away from the rest of the chip 40.

Figure 4:
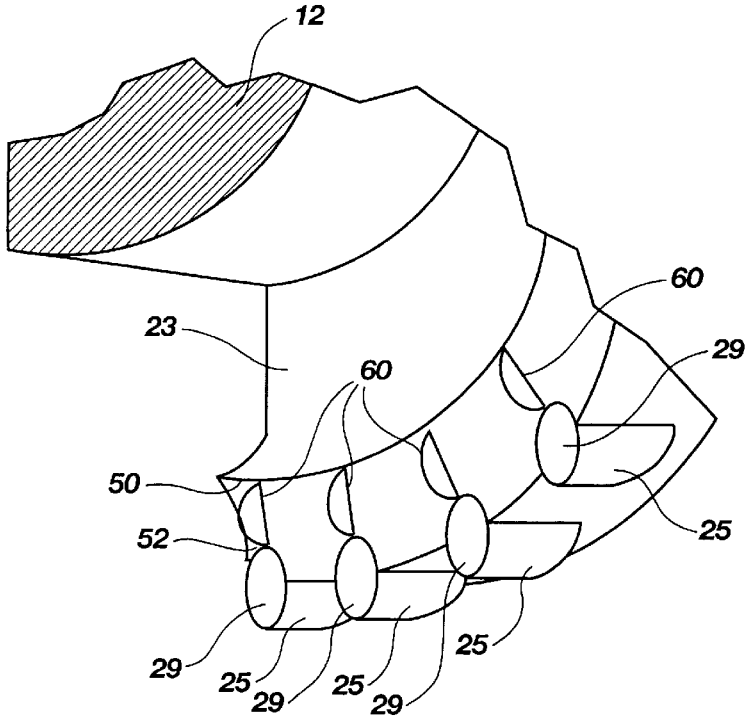
FIG. 4 is a partial sectional view of a third embodiment of a rotary-type drill bit in accordance with the present invention.

As illustrated in FIG. 4, a plurality of chip splitters 60 is provided proximate the cutting face 29 of each cutting element 25 and is positioned on a ramped surface 52, whether straight (i.e. planar) or curved (i.e., concave). It is also contemplated that the chip splitters 60 could be used in conjunction with any of the chip breakers illustrated in U.S. Pat. No. 5,582,258 to Tibbitts et al., which is incorporated herein by this reference. Splitting the chip provides a more narrow, less cohesive chip that can more easily move across the ramped surface 52 of the fluid course 23 until it overhangs the top edge or peak 50 of the ramped surface 52 and can be easily carried away by drilling fluid.

In FIG. 4, the chip splitters 60 are comprised of a semi spherical protuberance, or an elliptical protuberance extending from the ramped surface 52. Preferably, the chip splitter 60 projects from the ramped surface 52 at its highest point at least a distance equal to the maximum thickness of the chip being cut, or approximately equal to the radius of cutting element 25. However, a chip splitter 60 that does not project from the ramped surface 52 a distance at least equal to the anticipated or predicted depth of cut may still sufficiently split the chip in two or scribe or "kerf" the chip as the chip slides over the chip splitter so as to be easily broken by the force of the flowing drilling fluid.

Figure 5A:
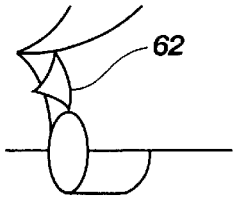
FIGS. 5A–5E are partial sectional views of fourth through eighth embodiments, respectively, of drill bits in accordance with the present invention.
Figure 5B:
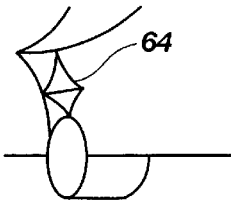
Figure 5C:
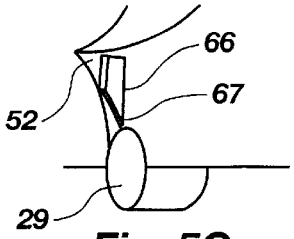
Figure 5D:
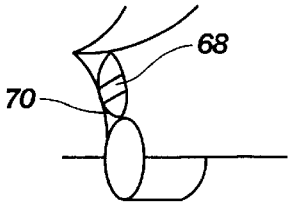
Figure 5E:
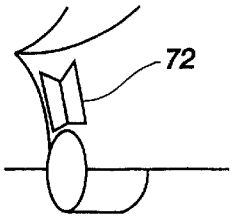

FIGS. 5A–5E illustrate several other embodiments of chip splitters in accordance with the present invention. In FIG. 5A, the chip splitter 62 is illustrated as a cone-shaped protrusion or protuberance. In FIG. 5B, the chip splitter 64 is comprised of a diamond-shaped protuberance. FIG. 5C shows the chip splitter 66 as having a knife-like leading edge 67 extending from the ramped surface 52 proximate the cutting face 29. Likewise, FIG. 5D illustrates another knife-like protuberance 68 providing a relatively sharp edge 70 to cut the chip in two. Finally, in FIG. 5E, the chip splitter 72 is comprised of a simple three-dimensional rectangular protrusion. It will be recognized by those skilled in the art that, while not specifically illustrated, other configurations of chip splitters in accord with the present invention can be devised, including modifications and/or combinations of those chip splitters illustrated and described herein. For example, the chip splitters could extend substantially the entire depth of the ramped surface 52 from proximate the cutting face 29 to the peak 50.

In addition, the chip splitters and chip breakers herein described may be manufactured as an integral part of the bit body 12 by providing for them in bit molds for cast or molded bits or forming them in the surface topography of a layered-manufactured bit. Likewise, the chip splitters and chip breakers may be individually manufactured of tungsten carbide, for example, for erosion and abrasion resistance, and attached to the "leading" side wall 26 (FIGS. 1–3) or the ramped surface 52 (FIG. 4) of the fluid course 23 by bonding, brazing, or other methods known in the art.

Those skilled in the art will appreciate that one or more features of the illustrated embodiments may be combined with one or more features from another embodiment to form yet another combination within the scope of the invention as described and claimed herein. Thus, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A rotary drill bit for drilling subterranean formations, comprising:

a bit body having a crown, the crown having a face;

a plurality of cutting elements defining a cutting surface and attached to the crown; and a plurality of chip splitting protrusions extending from the face of the crown, each positioned proximate one of the plurality of cutting elements and in a potential path of a formation chip to be generated by at least one of the plurality of cutting elements during drilling.

2. The rotary drill bit of claim 1, further including a ramped surface on the face of the crown adjacent at least one of the plurality of cutting elements wherein at least one of the plurality of chip splitting protrusions is positioned on the ramped surface.

3. The rotary drill bit of claim 1, wherein at least one of the plurality of chip splitting protrusions includes a knife-like leading edge.

4. The rotary drill bit of claim 1, wherein at least one of the plurality of chip splitting protrusions is in the form of at least one of the group comprising a semispherical protrusion, an elliptical protrusion, a cone-shaped protrusion, a diamond-shaped protrusion, and a rectangular protrusion.

5. The rotary drill bit of claim 1, wherein a longitudinal axis of at least one of the plurality of chip splitting protrusions is substantially aligned with a center of the cutting surface of one of the proximately positioned cutting elements thereof.

6. A rotary drill bit for drilling subterranean formations, comprising:

a bit body having a plurality of fluid courses extending along the bit body;

a plurality of cutting elements, each having a cutting face, each cutting element attached adjacent one of the plurality of fluid courses; and a plurality of knife-like protrusions, each knife-like protrusion proximate the cutting face of one of the plurality of cutting elements.

7. The rotary drill bit of claim 6, further including at least one ramped surface in at least one of the plurality of fluid courses, wherein at least one of the plurality of knife-like protrusions is positioned on the at least one ramped surface.

8. The rotary drill bit of claim 7, wherein the at least one ramped surface is a concave surface.

9. The rotary drill bit of claim 7, further including a plurality of ramped surfaces, at least one of the plurality of ramped surfaces in each of the plurality of fluid courses and at least one of the plurality of knife-like protrusions extending from each of the plurality of ramped surfaces.

10. The rotary drill bit of claim 6, wherein the plurality of knife-like protrusions is in the form of at least one of the group comprising a semispherical protrusion, an elliptical protrusion, a cone-shaped protrusion, a diamond-shaped protrusion, and a substantially rectangular protrusion.

11. The rotary drill bit of claim 6, wherein a longitudinal axis of each of the plurality of knife-like protrusions is substantially aligned with a center of the cutting face of one of the proximately positioned cutting elements.

12. A rotary drill bit for drilling subterranean formations, comprising:

a plurality of cutting elements, each having a cutting face;

a bit body defining at least one fluid course extending substantially longitudinally along at least a portion of the bit body, the plurality of cutting elements attached adjacent the at least one fluid course, the at least one fluid course having a side wall including a ramp adjacent the plurality of cutting elements extending partially into the at least one fluid course and extending substantially longitudinally within the at least one fluid course relative to the plurality of cutting elements; and a plurality of protrusions, each positioned proximate the ramp and adjacent the cutting face of one of the plurality of cutting elements.

13. The rotary drill bit of claim 12, wherein the plurality of protrusions each define a chip splitter.

14. The rotary drill bit of claim 13, wherein at least one of the plurality of chip splitters includes a knife-like leading edge.

15. The rotary drill bit of claim 12, wherein the plurality of protrusions is in a form of at least one of a group comprising a semispherically shaped protrusion, an ellipticalshaped protrusion, a cone-shaped protrusion, a diamond-shaped protrusion, and a substantially rectangular protrusion.

16. The rotary drill bit of claim 12, wherein a longitudinal axis of each of the plurality of protrusions is substantially aligned with a center of the cutting face of one of the proximately positioned cutting elements thereof.

17. The rotary drill bit of claim 12, wherein at least one of the plurality of protrusions is positioned on the ramp.

18. A method of drilling a subterranean formation with a rotary-type drill bit, comprising:

rotating a rotary drill bit having a plurality of fluid courses and a plurality of cutting elements adjacent the plurality of fluid courses into a subterranean formation and engaging the formation with cutting elements of the plurality to generate chips of formation material;

supplying drilling fluid through the plurality of fluid courses to the plurality of cutting elements as the cutting elements engage the formation;

splitting the chips of formation material generated by the plurality of cutting elements engaging the formation into at least two chip segments; and carrying the split chips of formation of material through the plurality of fluid courses with the supplied drilling fluid.

19. The method of claim 18, further comprising twisting the chips of formation material generated by the plurality of cutting elements.

20. A method of drilling a subterranean formation with a rotary-type drill bit, comprising:

rotating a drill bit having a plurality of fluid courses and a plurality of cutting elements adjacent the plurality of fluid courses into a subterranean formation and engaging the formation with cutting elements of the plurality to generate chips of formation material;

supplying drilling fluid through the plurality of fluid courses to the plurality of cutting elements as the cutting elements engage the formation;

scribing the chips of formation material generated by the plurality of cutting elements engaging the formation;

breaking the scribed chips of formation material; and carrying the broken chips of formation material through the plurality of fluid courses with the supplied drilling fluid.

21. A method of drilling a subterranean formation with a rotary-type drill bit, comprising:

rotating a drill bit having a plurality of fluid courses and a plurality of cutting elements, each adjacent surfaces defined by the plurality of fluid courses into a subterranean formation and engaging the formation with cutting elements of the plurality to generate chips of formation material;

supplying drilling fluid through the plurality of fluid courses to the plurality of cutting elements as the cutting elements are engaging the formation;

lifting chips of formation material generated by at least one of the plurality of cutting elements away from the surface defined thereby;

splitting the chips of formation material generated by the at least one of the plurality of cutting elements into at least two chip segments; and carrying the split chips of formation material through the plurality of fluid courses with the supplied drilling fluid.

22. The method of claim 21, further comprising twisting the chips of formation material generated by the at least one of the plurality of cutting elements.

* * * * *